US008311454B2

(12) United States Patent
Fujii

(10) Patent No.: US 8,311,454 B2
(45) Date of Patent: Nov. 13, 2012

(54) IMAGE FORMING APPARATUS

(75) Inventor: Makoto Fujii, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 279 days.

(21) Appl. No.: 12/833,037

(22) Filed: Jul. 9, 2010

(65) Prior Publication Data

US 2011/0013936 A1 Jan. 20, 2011

(30) Foreign Application Priority Data

Jul. 15, 2009 (JP) ..... 2009-166450

(51) Int. Cl.
*G03G 15/16* (2006.01)
*G03G 15/20* (2006.01)

(52) U.S. Cl. ..... 399/122; 399/328

(58) Field of Classification Search ..... 399/122, 399/328, 334

See application file for complete search history.

(56) References Cited

U.S. PATENT DOCUMENTS 7,113,722 B2 * 9/2006 Chung et al. ..... 399/90
7,142,793 B1 * 11/2006 Potter et al. ..... 399/69

FOREIGN PATENT DOCUMENTS

JP 9-265219 A 10/1997
JP 2003-263090 A 9/2003
JP 2007-148336 A 6/2007

* cited by examiner

*Primary Examiner* — Joseph S Wong
(74) *Attorney, Agent, or Firm* — Cantor Colburn LLP

(57) ABSTRACT

An image forming apparatus, having: an image forming section to form a toner image on a sheet; a fixing device to fix the tone image on the sheet at a nip section having a pair of fixing members pressing each other to form the nip section and a heat source disposed on at least one of the fixing members to heat the fixing member; a swing section to swing the pair of the fixing members so that the fixing members displace relatively with respect to the sheet in a width direction which is perpendicular to a sheet conveyance direction, and a heat source support section to support the heat source in a way that a position of the heat source is maintained constantly with respect to the sheet in the width direction.

8 Claims, 11 Drawing Sheets

IMAGE FORMING APPARATUS

This application is based on Japanese Patent Application No. 2009-166450 filed on Jul. 15, 2009, in Japanese Patent Office, the entire content of which is hereby incorporated by reference.

BACKGROUND OF THE INVENTION

The present invention relates to a fixing device to fix an image formed on a sheet and an image forming apparatus.

In recent years, there have been increasing demands of outputting high quality image and long lifespan of parts related to the electrophotographic process for image forming apparatuses of electrophotographic method such as printers and digital multifunction peripheries from the market.

In response to such demands from the market, there is suggested a technology which distributes abrasion of the fixing roller caused by the side edge section of the sheet repeatedly passing through the fixing apparatus so that the abrasion does not concentrate on one portion of the fixing roller surface (Patent documents 1 to 3: Unexamined Japanese patent application publication No. H9-265219, 2003-263090 and 2007-148336). As a result, deterioration of an image (smear and uneven glaze) caused by abrasion of the roller surface and early replacing of the fixing roller due to the deterioration of the image can be obviated and longivity is realized.

In an image forming apparatus of Patent Document 1 (Unexamined Japanese patent application publication No. H9-265219), on an upstream side of a fixing device, there is disposed a transfer conveyance mechanism to convey a transfer sheet after skewing the sheet by a predetermined angle with respect to the fixing roller. Whereby, when one piece of the transfer sheet passes through the fixing roller, the transfer sheet is conveyed while a contact portion between the side edge section of the transfer sheet and the fixing roller is moving in an axis direction of the fixing roller. As a result, the contact portion of the fixing roller with the side edge section of the transfer sheet changes continuously, thus local abrasion is obviated.

An image forming apparatus described in Patent Document 2 (Unexamined Japanese patent application publication No. 2003-263090), on an upstream side of the image forming section, there is disposed a position changing device which enables to change a position of the transfer sheet in a width direction so that a starting position of writing in the image forming section is changed in accordance with a position of the transfer sheet to be conveyed to the transfer section. As a result, the side edge of the sheet entering into a nip section of the fixing roller shifts in the width direction relatively so as to obviate local abrasion of the transfer fixing body caused by the side edge of the sheet.

An image forming apparatus described in Patent Document 3 (Unexamined Japanese patent application publication No. 2007-148336) displaces a positional relation between the sheet conveyed from the sheet feeding apparatus and the transfer fixing body of the transfer fixing apparatus in the width direction relatively so that the local abrasion of the transfer fixing body caused by the side edge of the sheet is obviated.

Patent Document 1: Unexamined Japanese patent application publication No. H9-265219

Patent Document 2: Unexamined Japanese patent application publication No. 2003-263090

Patent Document 3: Unexamined Japanese patent application publication No. 2007-148336

Meanwhile, the inventions of the above patent documents have the following problems.

In the Patent document 1, the sheet as a whole skews between the fixing apparatus and the transfer section, and the sheet having been skewed is conveyed in the sheet conveyance direction while maintaining the posture of the sheet as it is. Thus, a complicated and large transfer sheet conveyance mechanism will be necessary. Therefore, there are problems that the cost increases and the apparatus grows in size.

In the Patent Document 2, a position changing device to displace the whole sheet in the width direction is needed between the transfer section and the sheet feeding apparatus, thus the cost increases and the apparatus glows in size in the same manner as the Patent document 1. Also, since a temperature distribution of the fixing roller with respect to the sheet entering into the fixing device changes, a balance of amount of heat supplied to each section of the sheet is not steady, thus fixing failure such as uneven fixing (graze and degree of fixing) and crinkle of the sheet have occurred.

In the Patent Document 3, since the transfer fixing body displaces in the width direction relatively with respect to the sheet, a problem of uneven fixing (graze and degree of fixing) of the toner image on the sheet exists because of the same reason as the Patent Document 2. Also, since it has a structure that only the transfer fixing body is displaced in the width direction with respect to the sheet entering into the transfer fixing device, a mechanism to separate the pressure roller from the transfer fixing body when the transfer fixing body is moved or a mechanism to move the transfer fixing body in the axis direction by a strong force against a pressure of the pressure contact roller is needed, thus there is a problem in a view point of a practical application.

The present invention has one aspect to resolve the above problems and an object of the present invention is to provide an image forming apparatus capable of attaining longevity of the fixing roller without having problems of uneven fixing and the crinkle of the sheet by stabilizing balance of the amount of heat supplied to each portion of the sheet and obviating local abrasion to occur on the fixing roller.

SUMMARY

The aforesaid object can be achieved by the following.

To achieve at least the one of the abovementioned objects, an image forming apparatus reflecting the present invention having: an image forming section to form a toner image on a sheet; a fixing device to fix the tone image on the sheet at a nip section having a pair of fixing members pressing each other to form the nip section and a heat source disposed on at least one of the fixing members to heat the fixing member; a swing section to swing the pair of the fixing members so that the fixing members displace relatively with respect to the sheet in a width direction which is perpendicular to a sheet conveyance direction, and a heat source support section to support the heat source in a way that a position of the heat source is maintained constantly with respect to the sheet in the width direction.

Figure 10:
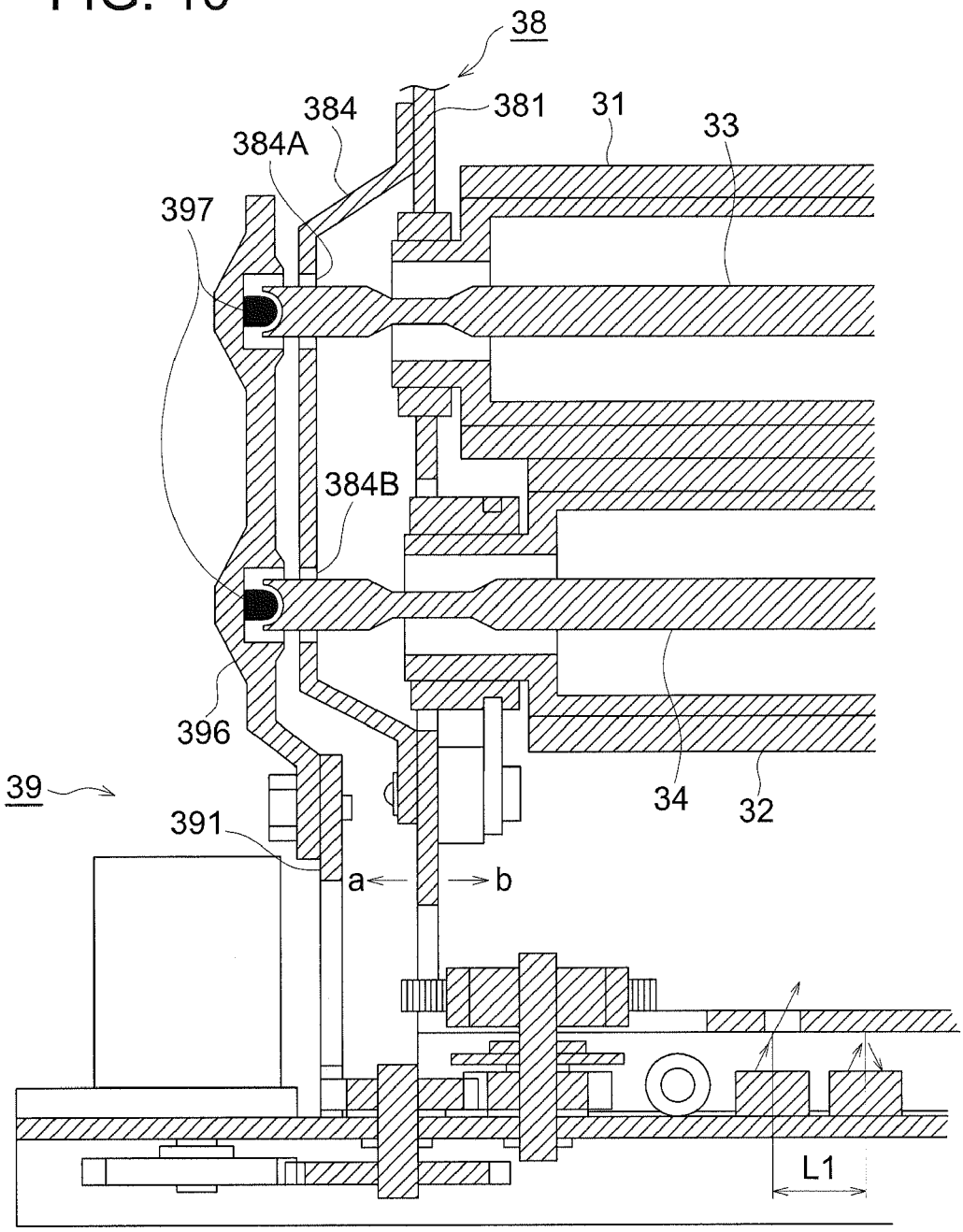

FIG. 10 is a front view showing a fixing device and device mount section to indicate a relevant portion of the fixing device 30 representing an embodiment in which heat sources 33 and 34 can be detached from the image forming apparatus collectively.

Figure 11A:
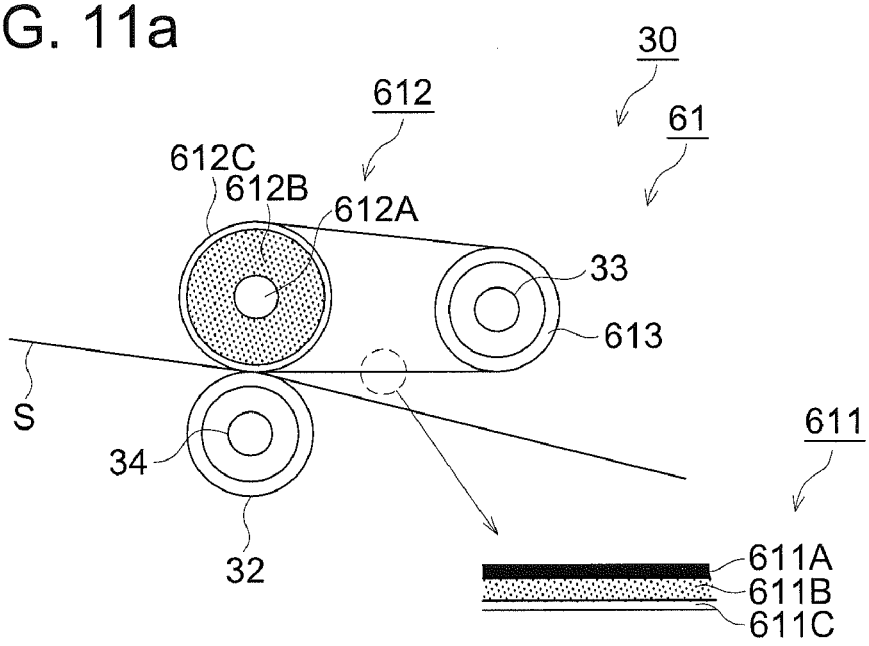
Figure 11B:
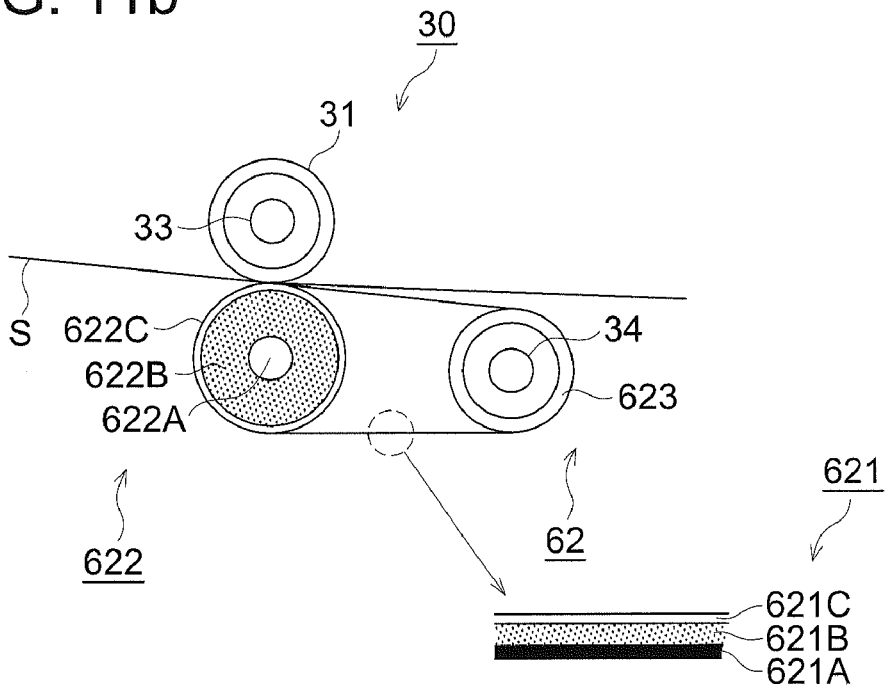

FIG. 11*a* and FIG. 11*b* are schematic diagrams showing examples of fixing devices where a heat-resistant endless belt disposed in a rotation manner is used for at least one of a pair of a fixing member.

DETAILED DESCRIPTION OF PREFERRED EMBODIMENTS

The present invention will be described based on embodiments without the present invention being limited to the embodiments thereof.

<Image Forming Apparatus>

Figure 1:
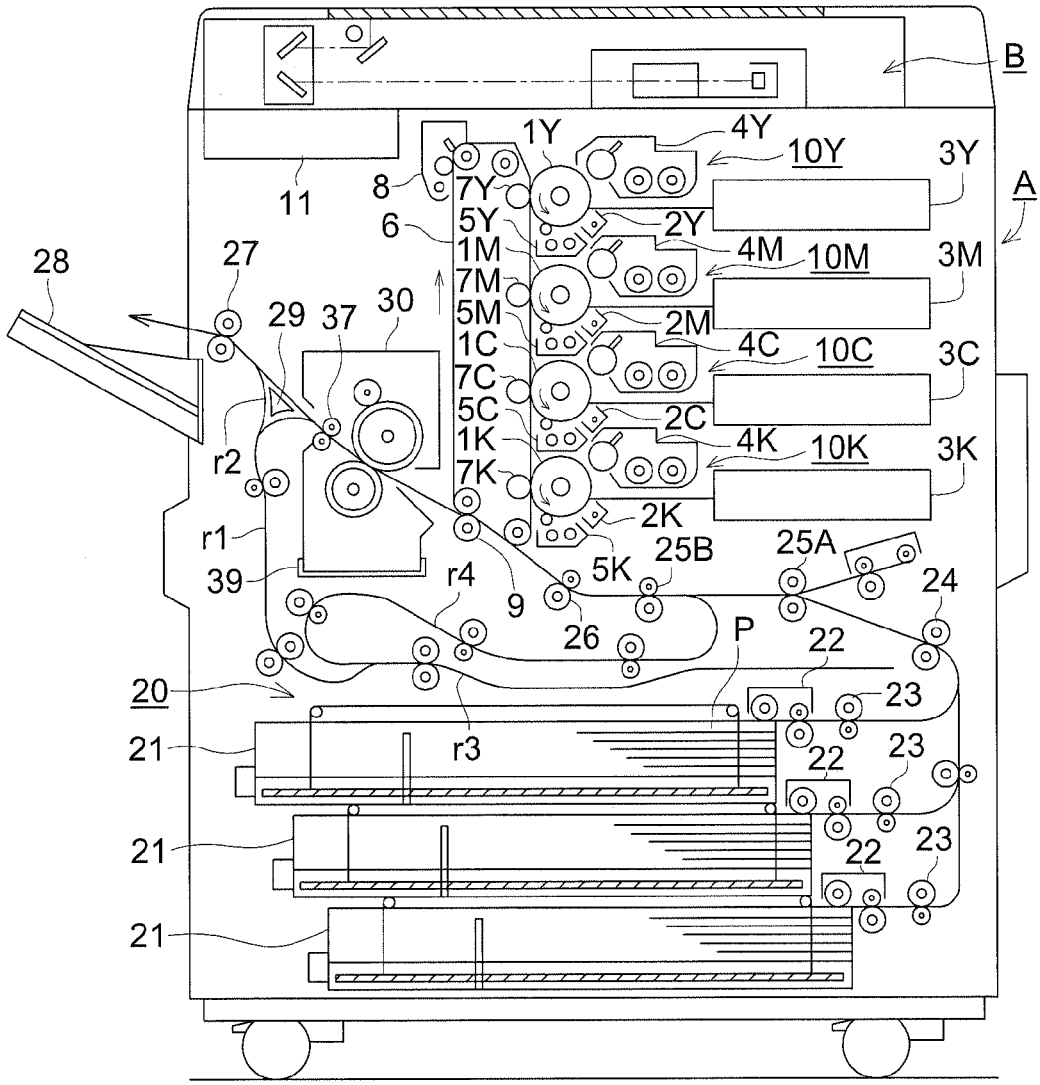
FIG. 1 is a configuration diagram of an image forming apparatus A provided with a fixing device related to the present invention.

FIG. 1 is a configuration diagram of an image forming apparatus A provided with a fixing device related to the present invention.

The image forming apparatus A is so-called a tandem type color image forming apparatus configured with an image forming section 10, a sheet feeding device 20 and a fixing device 30 and so forth. The image forming section 10 is configured with a plurality of groups for respective color image forming sections 10Y, 10M, 10C and 10K and a transfer section.

On an upper part of the image forming apparatus A, an image reading apparatus B is installed. A document placed on the document table is subject to scan exposure through an optical system of a document image scan exposure device of the image reading apparatus B so that, an image is read by a line image sensor. An analogue signal optically converted by the line image sensor is inputted to exposure devices 3Y, 3M, 3C and 3K after having been subject to analogue processing, A/D conversion, shading correction, and image compression processing.

Y color image forming section 10Y to form an image of yellow (Y) color is provided with a charging device 2Y, an exposing device 3Y, a developing device 4Y and a cleaning device 5Y at a circumference of a photoconductive drum 1Y representing an image carrier. M color image forming section 10M to form an image of magenta (M) color is provided with a charging device 2M, an exposing device 3M, a developing device 4M and a cleaning device 5M at a circumference of a photoconductive drum 1M representing an image carrier. C color image forming section 100 to form an image of cyan (C) color is provided with a charging device 2C, an exposing device 3C, a developing device 4C and a cleaning device 5C at a circumference of a photoconductive drum 1C representing an image carrier. B color image forming section 10B to form an image of black (B) color is provided with a charging device 2B, an exposing device 3B, a developing device 4B and a cleaning device 5B at a circumference of a photoconductive drum 1B representing an image carrier. The charging device 2Y and the exposing device 3Y, the charging device 2M and the exposing device 3M, the charging device 2C and the exposing device 3C and the charging device 2K and the exposing device 3K configure latent image forming devices.

Symbols 4Y, 4M, 4C and 4K are developing devices which contain a binary developer configured with a small particle size toner and a carrier.

The transfer section is configured with an intermediate transfer member 6 in a belt shape rotatably supported to be rotated by a plurality of rollers, a first transfer section having first transfer devices 7Y, 7M, 7C and 7K, and a second transfer section having a second transfer device 9.

The toner images of respective colors formed by respective color image forming sections 10Y, 10M, 10C and 10K are successively transferred onto the rotating intermediate transfer member 6 through the first transfer devices 7Y, 7M, 7C and 7K of the first transfer section and a combined color image is formed.

A recording medium S (hereinafter called sheet) stored in a sheet storing section (sheet feeding cassette) 21 of the sheet feeding device 20 is fed by a sheet feeding device (first sheet feeding section) 22, and conveyed to the second transfer device 9 of the second transfer section via sheet feeding rollers 23, 24, 25A, 25B and registration rollers (second sheet feeding section) 26, whereby a color image is transferred onto the sheet S. As above, the toner image configured with each color toner image is formed on the sheet S via the image forming section 10.

Incidentally, the three-stage sheet storing sections 21 disposed in parallel in a vertical direction at a lower portion of the image forming apparatus A have almost the same configuration and are denoted by the same symbols. Also, the three-stage sheet feeding devices 22 have almost the same configuration and are denoted by the same symbols. The sheet storing section 21 including the sheet feeding device 22 are called a sheet feeding apparatus 20.

A size and a kind of the sheet S stored in the sheet storing section 21 is displayed on a display screen of an operation section 11 and selected and set discretionary. Also, the size of the sheet S can be set automatically based on the size of the document and a magnification ratio of copying.

The sheet S on which the color image has been formed by the image forming section 10 is conveyed to the fixing device 30. Here, heat and pressure are applied so that the color toner image (or toner image) is fixed onto the sheet S.

The sheet S having been subject to the fixing process is nipped and conveyed by a conveyance roller pair 37 and ejected outside the apparatus through an ejection roller 27, then placed on an ejection sheet tray 28 located outside the apparatus.

On the other hand, after the second transfer device 9 transfers the color image onto the sheet S, residual toner on the intermediate transfer member 6 from which the sheet S has been separated by curvature is removed by the cleaning device 8.

In case the sheet S having been subject to the fixing process is ejected in reverse, the sheet S passes through a conveyance path on a right side of a diverging plate 29 disposed at a diverging point between the fixing device 30 and the sheet ejection roller 27, then after being conveyed to a conveyance path r1 (reversal conveyance path) the sheet S is conveyed in reverse. Then the sheet S is ejected outside the apparatus through the ejection rollers 27 via a conveyance path r2 on a left side of the diverging plate 29.

Incidentally, in the above description, while the image forming apparatus A forms the color image, the present embodiment includes that the forming apparatus A forms a monochrome image.

[Fixing Device]

Figure 2:
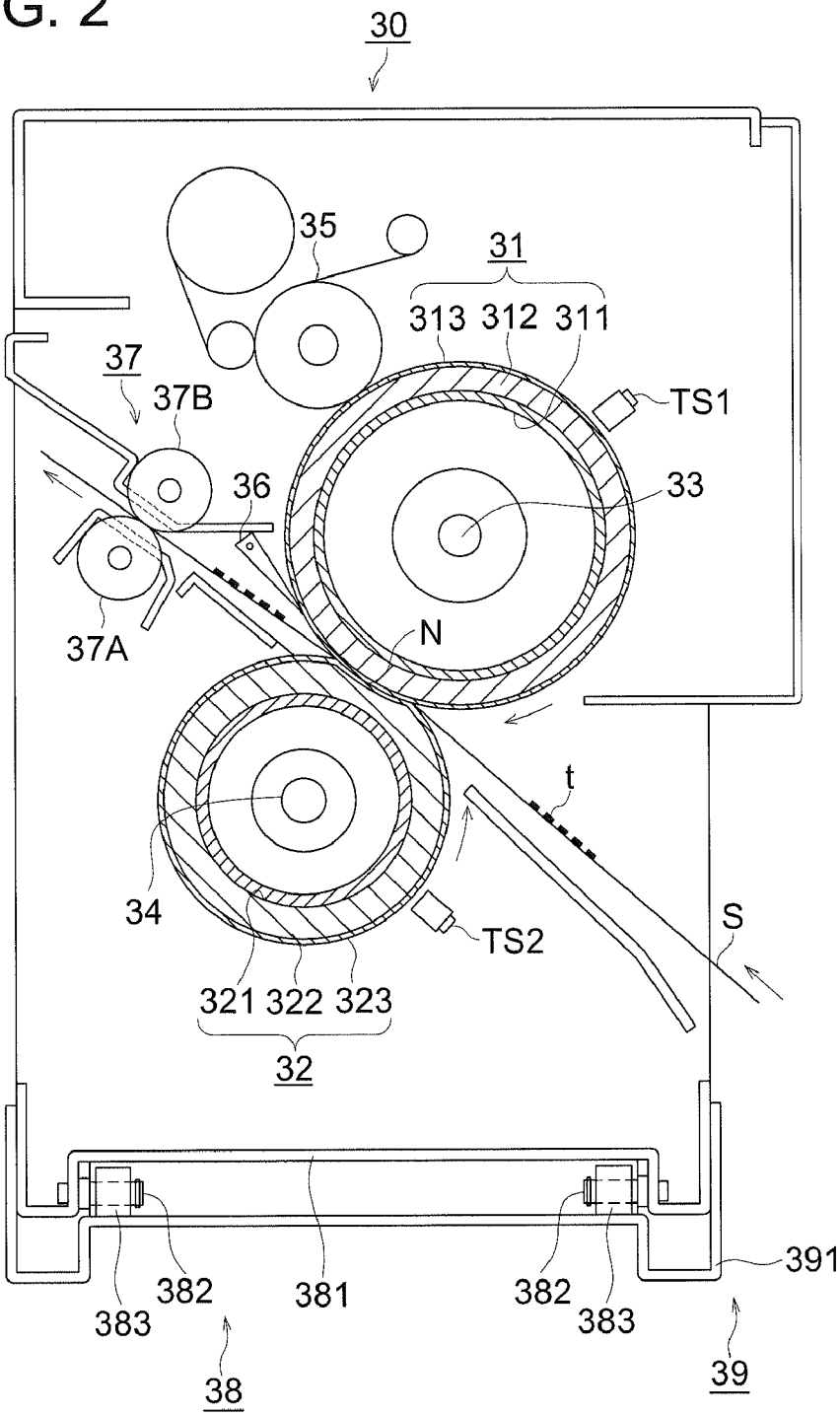
FIG. 2 is a cross sectional view showing an embodiment of a fixing device utilizing a heat roller method related to the present invention.

The fixing device 30 of the image forming apparatus A will be described as follow:

FIG. 2 is a cross-sectional view showing an embodiment of the fixing device 30 of a heat roller method.

The fixing device 30 is supported to be able to swing in a width direction which is orthogonal to the sheet conveyance direction in the device mount section 39.

The fixing device 30 is provided with a fixing roller 31 representing one side of a pair of fixing members, a pressure roller 32 representing another side of the pair of the fixing members, a heat source 33 to heat the fixing roller 31, and a heat source 34 to heat the pressure roller 32. The fixing roller 31 and the pressure roller 32 press each other to form a nip section N.

At a circumference of the fixing roller 31, a cleaning roller 35, a temperature detection device (temperature sensor) TS1, and an unillustrated thermostat to prevent abnormal temperature are provided. At a circumference of the pressure roller 32, a temperature detection device (temperature sensor) TS2, and an unillustrated thermostat to prevent abnormal temperature are also provided.

The heat sources 33 and 34 use halogen lamps or induction heating devices which are supported by heat source support section fixed on the device mount section 39 to be described in details.

The fixing roller 31 has a core metal 311 representing a heat conductive substrate and a heat-resistant resin covering a core metal 311. The heat-resistant-resin is configured with a heat-resistant elastic layer 312 and a heat-resistant covering layer 313.

The temperature detection device TS1 detects surface temperature of the fixing roller 31 and the surface temperature of the fixing roller 31 is controlled to maintain a predetermined temperature based on a detection signal from the temperature detection device TS1. When the sheet S enters in the nip section N, the sheet S is subject to actions of heat and presser in the nip section N. As a result, the toner image t on the sheet S is fixed onto the sheet S.

The fixing roller 31 is a cylindrical member having an external diameter of 20 to 70 mm configured with the heat conductive substrate 311, the heat-resistant elastic layer 312 and the heat-resistant covering layer 313. The heat conductive substrate 311 mainly uses an aluminum material having preferable heat conductivity as well as a non-magnetism stainless steel material and a heat-resistant glass material. The heat conductive substance 311 possesses a desirable mechanical strength and the thickness thereof is 0.8 to 10 mm.

The heat-resistant elastic layer 312 is formed with, for example, a heat-resistant elastic resin substance such as a silicone rubber and a fluorine-containing rubber. To cope with further speed up of image forming, there is preferred a method to enhance a heat conductivity, wherein as a filler, powder of metallic oxide such as silica, alumina, and magnesia oxide is added by 5 to 30 percent by mass. The mixed filler is preferred to have a superior electrical conductivity such as electrical conductive carbon black. Whereby, an electrical resistance (volume resistivity) of the heat-resistant elastic layer 312 can be set low readily. The thickness of the heat-resistant elastic layer 312 is 0.3 to 3 mm and preferably 1 to 3 mm and a rubber hardness is preferably 5 Hs to 30 Hs in JIS-A rubber hardness.

The heat-resist covering layer 313 covering an outer side (circumference surface) of the hear-resist elastic layer 312 is heat-resistant resin tube such as PFA and PTFE having a die releasablility.

The pressure roller 32 is a cylindrical member located a lower side to form a pair with the fixing roller 31 and configured with a heat conductive substrate 321, a heat-resistant elastic layer 322, and a heat-resistant covering layer 323. Composition members of the pressure roller 32 are formed with the composition members having almost the same materials, characteristics and dimensions as that of the fixing roller 31.

For example, the heat conductive substrate 321 is a carbon steel pipe for mechanical structure (STKM of Japanese Industrial Standards) having a thickness of 1 to 3 mm. The head-resist elastic layer 322 is a silicone rubber layer, a fluorine-containing rubber layer or a spongelike rubber layer using a silicone rubber foam material. The layer thickness of the heat-resist elastic layer is 0.3 mm to 5 mm and a hardness of rubber is 30 HS to 70 Hs (JIS-Rubber hardness A). The heat-resist covering layer 323 covering an outside (outer circumference surface) of the heat-resist elastic layer 322 is a heat-resist resin tube such as PFA and PTFE having a die releaseability. The pressure roller 32 has an outer diameter of approximately 30 to 70 mm.

The pressure roller 32 is rotatably supported at a fixing position and pressed against an upper side of the fixing roller 31 with a bias force of a spring so as to form a nip section N in a shape of a plane between the fixing rollers 31 and the pressure roller 32.

The sheet S passed through the nip section N is separated from outer circumferential surfaces of the pressure roller 32 and the fixing roller 31 and conveyed to a pair of conveyance rollers 37. A separation claw 36 located at a downstream side of the nip section N guides the sheet S separated from the fixing roller 31 smoothly to the conveyance roller pair 37.

<Fixing Member Support Section>

The fixing member support section 38 is provided with a housing 381 of the fixing device 30, four support axes 382 wherein two of them are fixed at a front side bottom section of the housing 381 and other two are fixed at a rear side thereof and a roller 383 rotatably supported by the each support axis 382. The fixing roller 31 and the pressure roller 31 representing a pair of fixing members are integrally supported in a rotation manner by the housing 381.

Namely, the fixing member supporting section 38 is mounted on the mount member 391 of the device mount section 39 via four rotation rollers 383 and movably supported in the width direction restricted by a restriction section 391A of the mount member 391.

Thus, the fixing roller 31 and the pressure roller 32 representing a pair of the fixing member supported by the housing 381 of the fixing member support section 38 can be moved in the width direction with respect to the device mount section 39.

<Swing Section>

Figure 3:
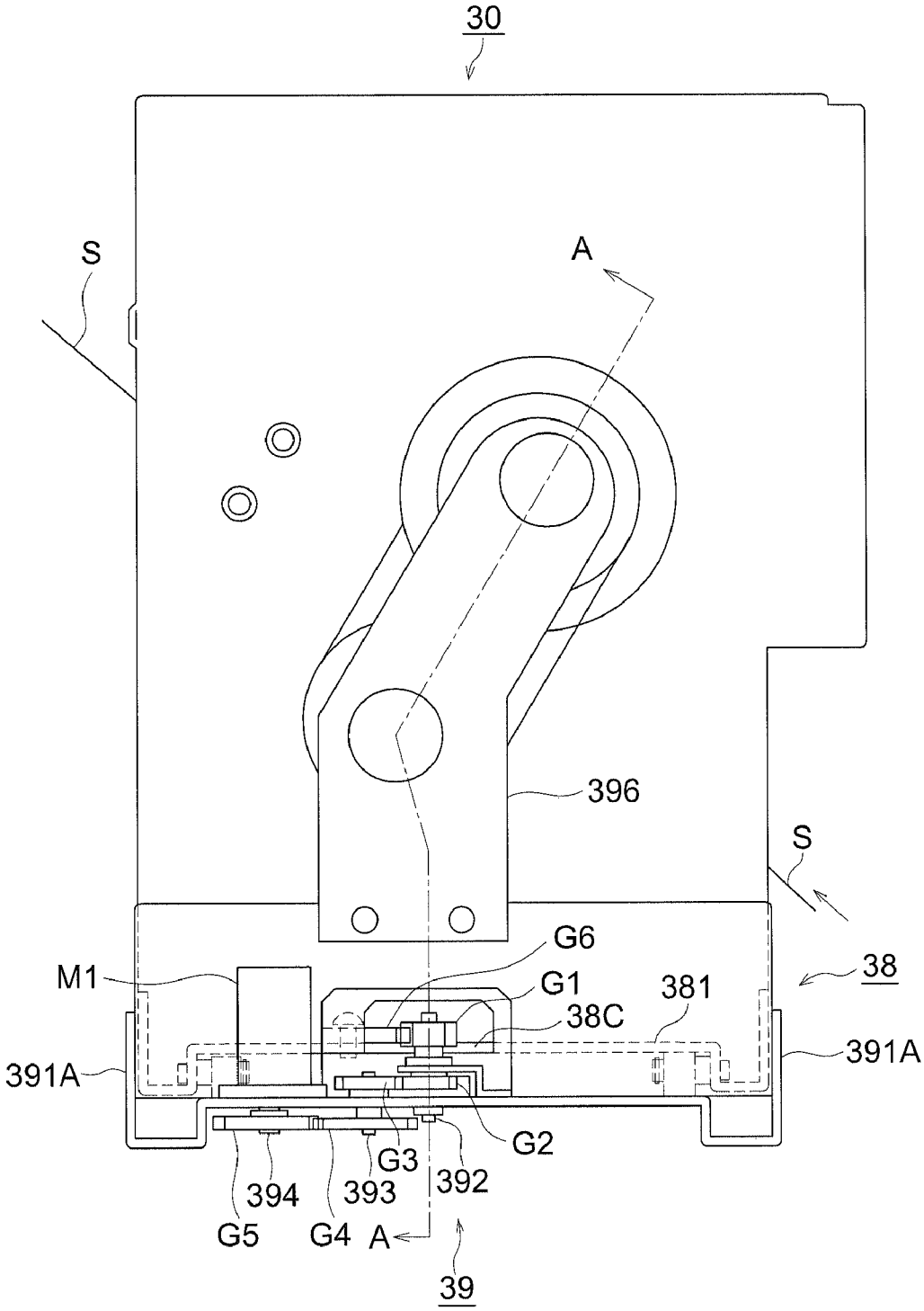
FIG. 3 is a front view showing a fixing device and a device mount section to indicate a swing section which swings the fixing device supporting a fixing roller in a width direction.
Figure 4:
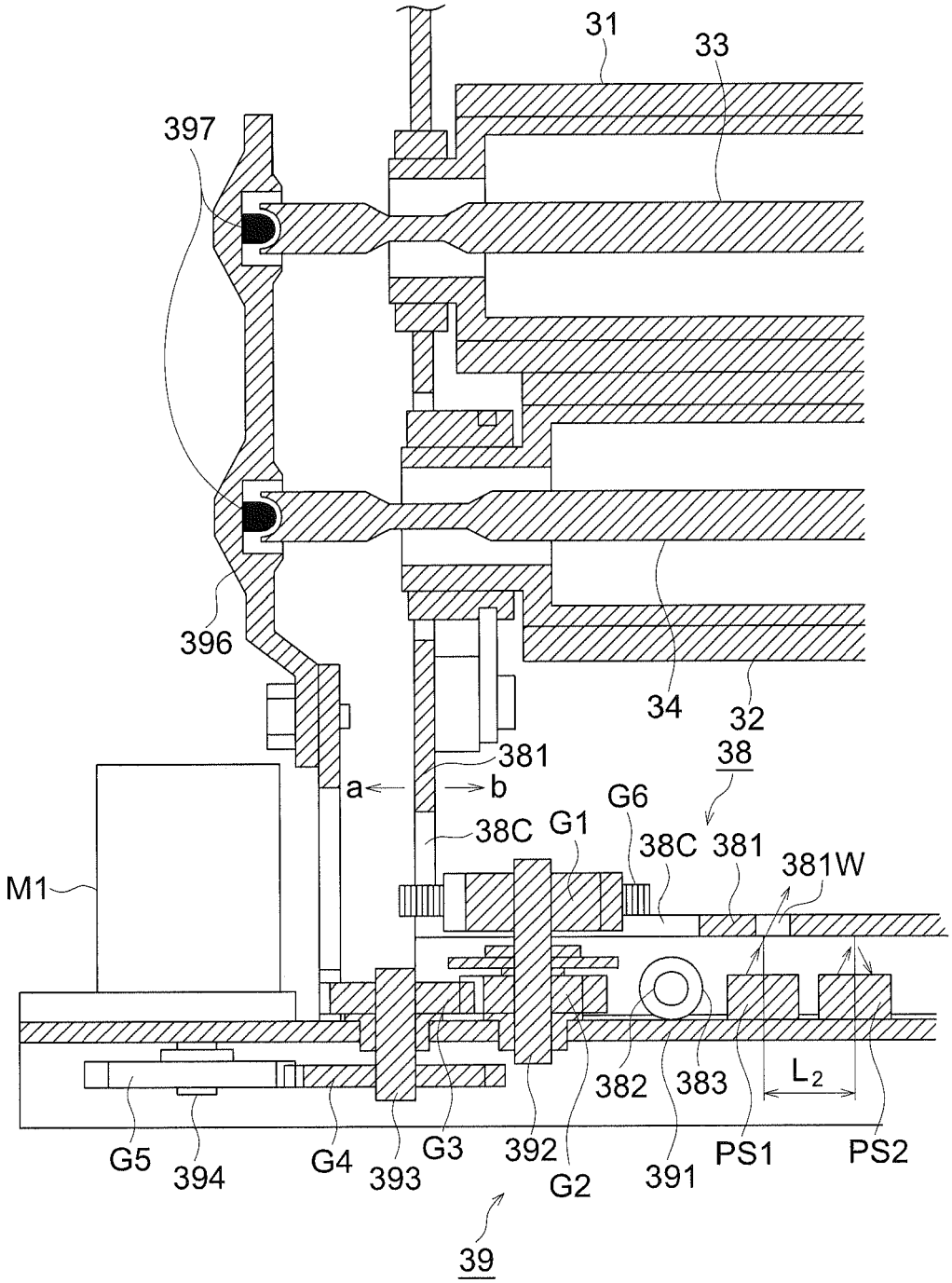
FIG. 4 is a magnified cross-sectional view showing a device mounting section representing a bottom section and a swing section of the fixing device.

FIG. 3 is a front view of the fixing device 30 and the device mount section 39 representing the swing section showing a swing section which swings the fixing member support section 38 to support the fixing roller 31 and the pressure roller 32 in the width direction. FIG. 4 is a magnified cross-sectional view (A-A cross-section in FIG. 3) of the bottom section 38 of the fixing device 30 and the device mount section 39 representing the swing section.

As FIGS. 3 and 4 show, the device mount section 39 representing the swing section is provided with the mount member 391 which supports the fixing device 30 and the fixing member support section 38 from underneath and a A rotation axis 392, a B rotation axis 393 and a C rotation axis 394 are fixed on the mount member 391 via fixed bearings vertically and rotatably.

A A gear G1 and a B gear G2 are installed on the A rotation axis 392 and a C gear G3 and a D gear G4 are installed on the B rotation axis 393. The C rotation axis 394 to which an E gear G5 is installed is a drive axis of a swing motor M1 fixed on the mount member 391.

The B gear G2 meshes with the C gear G3, and the D gear G4 meshes with the E gear G5. As a result, a drive train is configured so as to rotate the A gear G1 by driving the swing motor M1

A rack gear G6 configured by extending a flat gear in the width direction is fixed at a bottom notch section 38C of the housing 381 (Refer to FIG. 5) and meshed with the A gear G1 of the device mount section 39.

Whereby, the housing 381 of the fixing member support section 38 can be displaced in the width direction shown by an arrow a orb by driving the swing motor M1. In other words, the fixing roller 31 and the pressure roller 32 can be displaced in the width direction by driving the swing motor M1.

Figure 5:
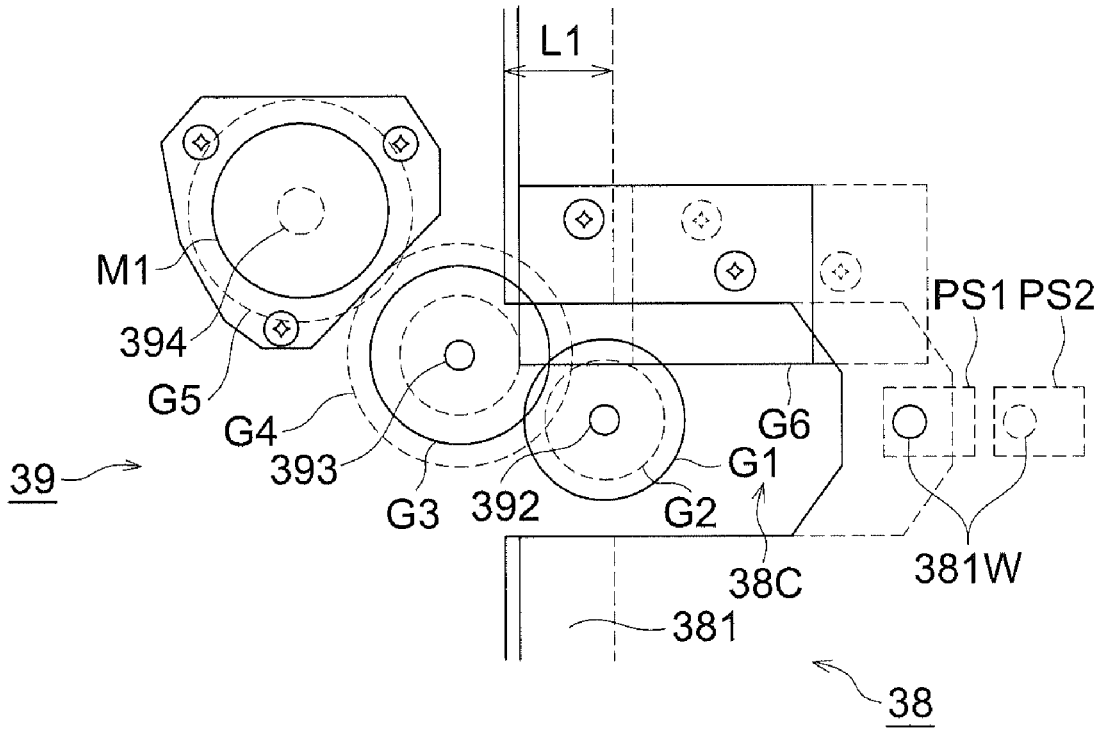
FIG. 5 is a plane view showing a state that a gear A and a rack gear of a swing section are meshing.

FIG. 5 is a schematic diagram (a plane view) showing a meshing state of the A gear G1 of the swing section and the rack gear G6.

Broken lines in the figure shows a state where the housing 381 and the rack gear G6 are displaced to an innermost side and a solid line shows the state of outermost side. L1 shows a swing range (a distance from the outermost sided to the innermost side) in which the housing 381 of the fixing device 30, namely the fixing roller 31 and the pressure roller 32 swings.

A first position sensor PS1 in the figure is a device to detect whether or not the housing 381 moved to the outermost side position, and a second position sensor PS2 is a device to detect whether or not the housing 381 moved to the innermost side position. The first position sensor PS1 and the second position sensor PS2 change a detection signal from On to Off when a detection hole W located on the bottom section of the housing 381 reaches at each position. As the figure shows, the detection position of the first detection sensor PS1 and the detection position of the second detection sensor PS2 are separated by a distance L2.

<Heat Source Support Member>

As FIGS. 2 and 4 show, the heat sources 33 and 34 are mounted and fixed on a pair of the heat source support members 396 (the inner side is not illustrated) which is fastened on the mount member 391 of the device mount section 39 by a screw.

The positional relation of the heat source 33 (34) with respect to the sheet S in the width direction is maintained steady. In the present invention, since the position of the sheet in the width direction is fixed, the position of the heat source 33 (34) in the width direction is fixed by the heat source support section 396. Incidentally, the position of the sheet S can be moved in the width direction by providing a sheet conveyance mechanism and so forth. Thus in accordance with displacement of the sheet in the width direction, the position of the heat source 33(34) can be moved by the heat source support section 396 so as to maintain the relative positional relation with the sheet S.

Whereby, the heat source 33 and the heat source 34 can be maintained at a given position despite swing motion of the fixing roller 31 or the fixing device 30 in the width direction. In other words, in spite of swing motion of the fixing roller 31 and the fixing device 30 in the width direction, the heating source 33 and the heating source 34 are retained at the given position with respect to the sheet S conveyed to the fixing device 30 based on the given position in the width direction in the image forming device A.

Inside the heat source support section 396, an unillustrated lead wire, and a convex terminal 397 in contact with a concave terminal of the heat source are provided so as to supply electric power to the heat source 33 and heat source 34.

A temperature distribution of the fixing roller 31 is mainly determined by a distribution of an amount of heat supplied to each portion of the fixing roller 31 from each portion of the heat source and by a distribution of the amount of heat drawn S from each portion of the fixing roller 31 by the sheet at the nip section. Whereby, a radiation amount of heat distribution of the heat source supplied from the heat source 33 to the fixing roller 31 has been determined through intensive study.

In the embodiment of the present invention, since the swing speed of the fixing roller 31 is 0.02 mm which is slow enough, the temperature distribution of the fixing roller 31 at each time point of swing motion is mainly determined by the amount of heat distribution supplied from each heat source 33.

In the embodiment related to the present invention, since the heat source 33 and the heat source 34 maintain the stable position with respect to the sheet S, in spite of swing motion of the fixing roller 31, the heat was supplied to the sheet S with excellent balance and a preferable image fixing has been provided without occurrence of fixing jam and sheet crinkle.

Figure 7:
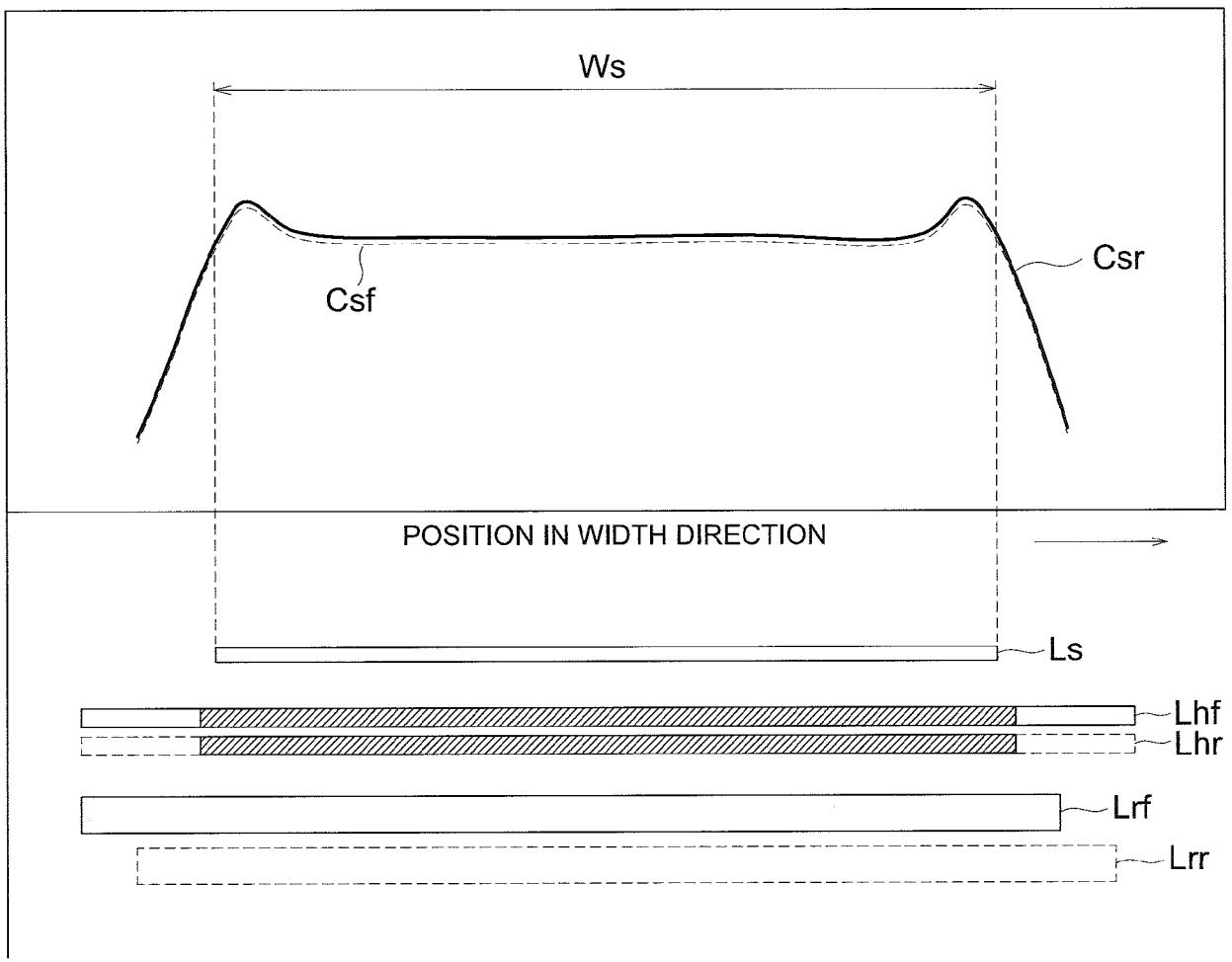
FIG. 7 is a schematic diagram showing a temperature distribution of a fixing roller and positional relations among a sheet, a heat source and a fixing roller of the embodiment related to the present invention.

FIG. 7 is a graph showing a temperature distribution of the fixing roller 31 with respect to a position where the sheet S occupies in the above embodiment related to the present invention.

At a lower section of the graph, a position Ls where the sheet S occupies, a position Lh where the heat source occupies, a position Lr where the fixing roller 31 occupies and positional relations of the positions thereof in the width direction are shown.

Symbols Lrf and Lrr denote positions where the fixing roller 31 occupies in the width direction, a solid line Lrf shows a position occupied by the fixing roller 31 when the fixing roller 31 swing the outermost side, and the broken lines Lrr shows a position occupied by the fixing roller 31 when the fixing roller 31 swing the innermost side.

Symbols Lhf and Lhr denote positions where the heat source 33 occupies in the with direction, the solid line Lhf shows a position where the heat source 33 occupies when the fixing roller 31 swings to the outermost side and the broken lines Lhr shows a position where the heat source 33 occupies when the fixing roller 31 swings to the innermost side. Hatching portions of the Lhf and Lhr show an area where the heat source is radiating heat to the fixing roller 31 substantially.

A graph of FIG. 7 will be described as follow.

A horizontal axis means a relative position with respect to the sheet S in the axis direction.

A vertical axis shows temperature of each section of the fixing roller 31 occupying the above relative position.

Lines Csf and Csr denote temperature distributions on the fixing roller 31 measured during continuous passing of the sheet S. The solid line Csf shows a temperature distribution on the fixing roller 31 measured when the fixing roller 31 swings to the outermost side. The broken lines Csr show a temperature distribution on the fixing roller 31 when the fixing roller 31 swings to the innermost side. Symbol Ws denotes a width of the sheet S.

As FIG. 7 shows, the temperature distribution of the fixing roller 31 in contact with the sheet S in the nip section is always unchanged despite the swing motion of the fixing roller 31 and the pressure roller 32 in the embodiment of the present invention, and the an appropriate amount of amount of heat is always supplied to the sheet S with a balance.

<An Embodiment of an Exemplary Comparison>

An embodiment of an exemplary comparison different from the present invention is to swing the fixing rollers 31 and the heat source integrally.

Figure 8:
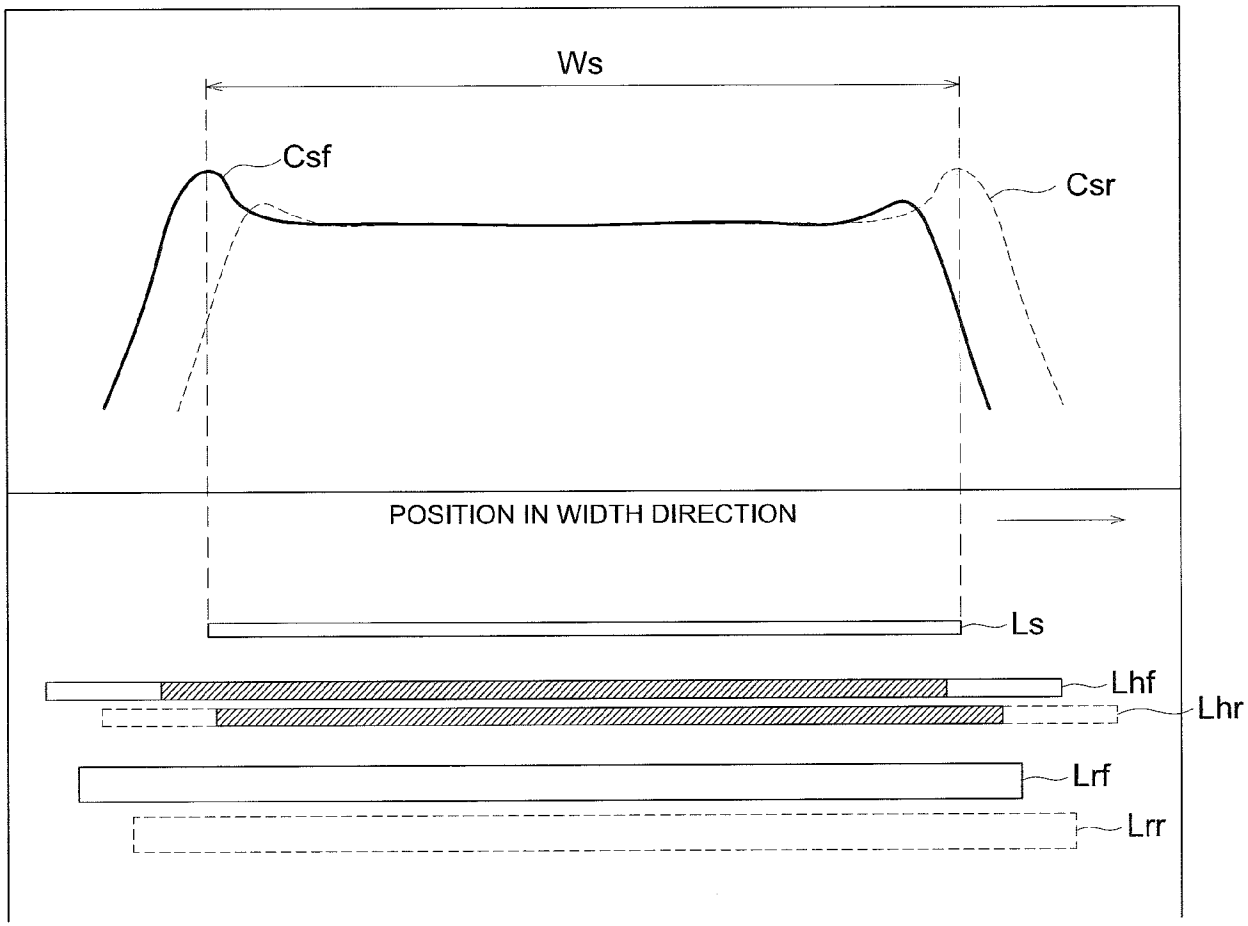
FIG. 8 is a schematic diagram showing a temperature distribution of a fixing roller and positional relations among a sheet, a heat source and a fixing roller of an embodiment of a comparison example.

FIG. 8 shows a heat distribution on the fixing roller 31 based on FIG. 7 in the embodiment of the exemplary comparison and positional relations among positions occupied by the sheet, the heat source and the fixing roller 31.

A graph in the FIG. 7 shows a temperature distribution on the fixing roller 31 with respect to a position occupied by the sheet S in the embodiment of the exemplary comparison.

In a lower section of the graph of the FIG. 8, a position Ls where the sheet S occupies, a position Lh where the heat source 33 occupies, a position Lr where the fixing roller 31 occupies and positional relations of the positions thereof in the width direction are shown.

Since the other positional relations are the same as that of the FIG. 7, except that the heat source 33 sings as the fixing roller swings, the explanation thereof will be omitted.

The graph of FIG. 8 will be described as follow.

Broken lines Csr and a solid line Csf show that the temperature distribution on the fixing roller 31 changes with the swing motion of the fixing roller 31, where the solid line Csf shows a temperature distribution on the fixing roller 31 measured when the fixing roller swings to the innermost side and the broken lines Csr show a temperature distribution on the fixing roller 31 when the fixing roller 31 swings to the outermost side. Symbol Ws denotes a width of the sheet S.

Whereby, in the embodiment related to the present invention, an amount of heat distribution of heat supplied form the fixing roller 31 to the each portion of the sheet S becomes unstable and a bias of the heat distribution occurs in the width direction. As a result, incomplete fixing due to unbalance of amount of heat supplied to the sheet S, uneven image quality, crinkle of the sheet and sheet jam occurred.

As above, in the embodiment related to the present invention, since the relative positional relation between the heat source 33 and sheet S is unchanged with respect to the swing motion of the fixing roller 31, the amount of heat supplied from the fixing roller 31 to each portion of the sheet S is always stable, thus occurrence of the above problem caused by incomplete fixing mentioned as above can be obviated.

<Control Block Configuration>

Figure 6:
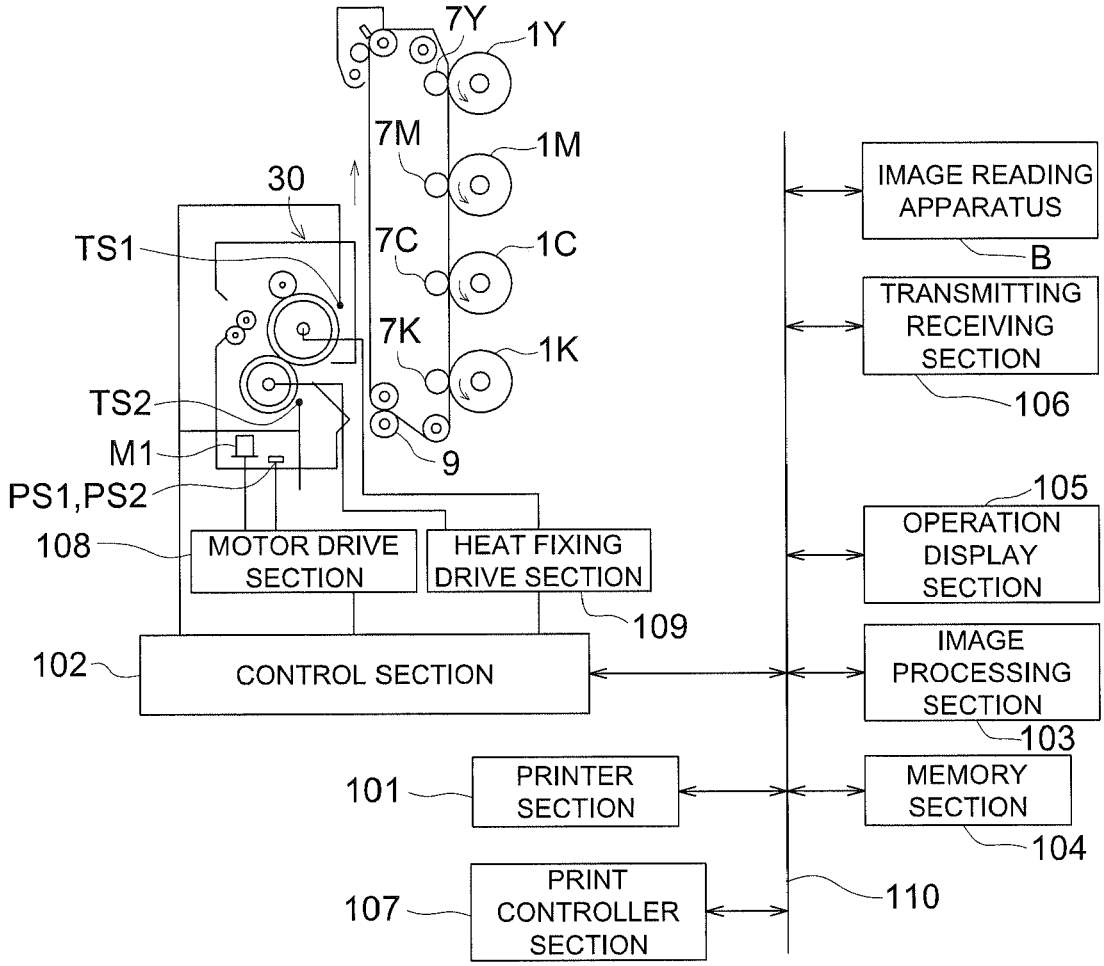
FIG. 6 is a control block diagram of an image forming apparatus.

FIG. 6 is a control block diagram of the image forming apparatus A.

The image forming apparatus A is configured with a print engine section 101, a control section 102, an image processing section 103, an operation display section 105, a memory section 104 and a transmitting and receiving section 106, a print controller section 107 and so forth. Each section is connected via a bus 110. The image forming apparatus A communicates with the image reading apparatus B installed on an upper section of the apparatus A.

The control section 102 is configured with a CPU, a ROM, a RAM and so forth. The CPU of the control section 102 reads a system program and various kinds of processing programs stored in the ROM and load them into the RAM. The control section 102 controls each section of the image forming apparatus A in accordance the loaded program integrally.

The operation display section 105 configured with a LCD (Liquid Crystal Display) displays various kinds of operation buttons, statuses of the apparatus and an operation condition of each function on a display screen in accordance with instructions of the display signals inputted from the control section 102. Also, various kinds of buttons such as numeral buttons and a start button are provided to output operation signals to the control section 102 through operation of the buttons.

The image read apparatus B reads a document as an analogue RGB signal and converts the analogue signal to a digital signal via an A/D converter so as to form RGB image data. After that, the image data is outputted to the image processing section 103 of the image forming apparatus A via the bus 110.

The image processing section 103 converts the RGB image data inputted from the image read apparatus B into image data of Y, M, C and K colors capable of being processed by the print engine section 101. Further, γ correction is carried out to accord with output characteristic of the print engine section 101 or a binarization process such as an error diffusion method is carried out to create print data of Y, M, C and K color. Then the print data is outputted to the print engine section 101.

The transmitting and receiving section 106 receives a print job from a personal computer on a network and transfers to the print controller section 107. The print job is configured with processing information related to printing process and print data (file).

The print controller section 107 creates print data representing image data of Y, M, C and K colors based on the contents of the print job and outputs to the print engine section 101 to correspond to the processing information.

The print engine section 101 loads the image date inputted from the print controller section 107 and the image processing section 103 onto an image memory and forms a color image on an intermediate transfer body through each of image forming sections 10Y, 10M, 10C and 10K by scanning subsequently. After that, the color image on the intermediate transfer body is transferred onto the sheet and the sheet is subject to the fixing process through the fixing device 30 and then outputted from the image forming apparatus A.

The control section 102 controls a fixing heat drive section 109 based on the detected temperature through the temperature detection devices TS1 and TS2 so as to turn on and off the heat sources 33 and 34 in order to control temperature of the fixing roller 31 and the pressure roller 32 of the fixing device 30 to be respective predetermined temperatures.

<Swing Motion Control of the Fixing Roller and Pressure Roller Related to the Present Embodiment>

The motor drive section 109 is provided with a drive circuitry to drive a swing motor M1 in a positive direction or a positive direction and an input circuitry of a first sensor PS1 and a second sensor PS2.

The control section 102 controls the swing motor M1 to drive based on the given program so as to swing the fixing roller 31 and the pressure roller 32 within the predetermined range in a width direction which is perpendicular to the sheet conveyance direction. For example, the motor drive section 103 is configured to rotate the swing motor M1 in a constant rotation speed. The fixing roller 31 and the pressure roller 32 move by a distance L1 towards a back side in the width direction by rotating the swing motor M1 in a positive direction for a time period T1 then by rotating in the negative direction for the time period T1, the rollers move by the distance L1 towards a front side. By repeating the above operation, the fixing roller 31 and the pressure roller 32 swing in the width direction.

The control section 102 conducts control to repeat positive rotation for the time period T1 and negative rotation for the time period T1 alternately so as to swing the fixing roller 31 and the pressure roller 32 within the range of L1.

Figure 9:
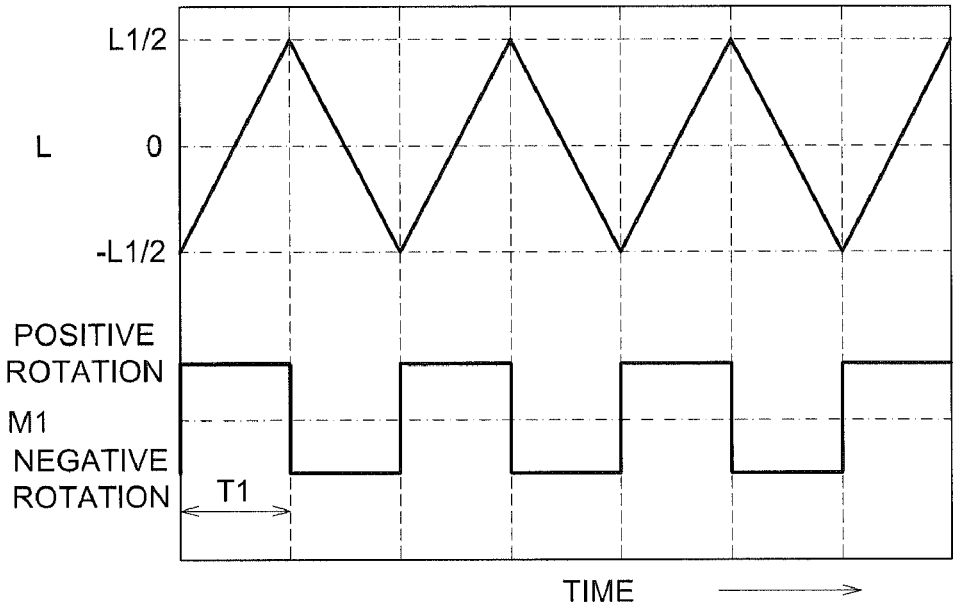
FIG. 9 shows a drive sequence of a drive motor M1 and a swing position of a fixing roller 31 and a pressure roller 32 of an embodiment of swing control related to the present invention.

FIG. 9 is an embodiment of swing motion control related to the present invention showing a drive sequence of the drive motor M1 and swing positions of the fixing roller 31 and the pressure roller 32. A symbol L to denote a distance of displacement of the fixing roller 31 and pressure roller 32 with respect to a reference position changes in the range from −L1/2 to +L1/2. Also, the plus symbol in the figure means swing position in the back side and minus symbol means that in the front side.

Here, since a position of the sheet S in the width direction conveyed to the fixing device 30 is fixed at almost a center of the image forming apparatus A, the sheet S is conveyed within the range of +L1/2 to −L1/2 with respect to the reference position of the fixing roller 31 and the pressure roller 32 by executing the aforesaid swing motion control. Thus, even if a large amount of the same size sheets S are used for a long period of time, a local abrasion of the fixing roller 31 caused by an edge section (in particular side edge section) of the sheet S is obviated.

Further, the control section 102 can control to drive the swing motor M1 so that the rotation direction of the drive motor M1 is changed based on a signals of the first position sensor PS1 and the second position sensor PS2. For example, when the signal of the first sensor PS1 changes from ON to OFF, the rotation direction of the drive motor M1 can change from the negative to the positive direction, and when the signal of the second sensor PS2 changes from ON to OFF, the rotation direction of the drive motor M1 can change from the positive to the negative direction so that the fixing roller 31 and the pressure roller 32 swing in the predetermined range in the width direction. The swing motion range in the above operation corresponds to a distance L2 (shown in FIG. 4) between detection positions of the first position sensor PS1 and the second position sensor PS2.

A swing speed of the fixing roller 31 is set low so that the crinkle and folding of the sheet S do not occur, even in case the sheet S is nipped by the second transfer device 9 and the nip N (FIG. 2) of the fixing device 30 simultaneously. If the displacing amount of the fixing roller 31, while a A3 size sheet passes through the fixing device 30 is approximately 0.02 mm, shrinking and folding of the sheet do not occur, incidentally the swing speed in the above case is usually less than 0.02 mm.

In the above swing motion control, while the swing positions of the fixing roller 31 and the pressure roller 32 are changed in accordance with operation time of the fixing device or the image forming apparatus A, the swing positions of the fixing roller 31 and the pressure rollers 32 can be changed in accordance with number and a length of the sheet S to be processed.

<Validation of Swing Distance L1>

Validation related to the swing distance L1 was conducted using the fixing device 30 of the embodiment related to the present invention. The results are show in Table 1. On the other hand, in the exemplary comparison, by operation the swing motor M1, 500,000 sheets were processed though the fixing device 30 of the embodiment of the present invention and adverse effects to image quality were investigated after processing 500,000 sheets.

TABLE 1

| | Without swing motion | With Swing motion | | | |
|---|---|---|---|---|---|
| Swing distance L1 (1 mm) | 0 | 3 | 6 | 9 | 15 |
| Evaluation result | D | C | B | A | A |

In the exemplary embodiment 1, the swing motor is controlled to be driven with the swing distance L1 of 3 mm, in the exemplary embodiment 2, the swing distance L1 is 6 mm, in the exemplary embodiment 3, the swing distance L1 is 9 mm and in the exemplary embodiment 4, the swing distance L1 is 15 mm.

The test results are classified as A, B, C, and D, wherein a symbol D denotes that unacceptable image quality differences caused by the sheet edge section occurred after processing 500,000 sheets, A symbol C denotes that unacceptable image quality differences caused by the sheet edge section occurred after processing 500,000 sheets, however a degree of image quality differences is obviously improved with respect to the comparison example.

A symbol B denotes that image quality differences equivalent to an allowable limit occurred after processing 500,000 sheets.

A symbol A denotes that image quality is superior to an allowable limit after processing 500,000 sheets.

As the Table 1 shows, it was confirmed that by swinging the fixing roller 31, the lifespan of the fixing roller related to a scuff caused by the sheet edge section can be extended. Also, it was confirmed that by increasing the swing distance L1, the lifespan of the fixing roller can be further extended. When L1 was 6 mm, a substantial effect was appeared. When L1 is more than 9 mm, a distinguish effect was observed.

<Scope of the Embodiment Related to the Present Invention>

The embodiment related to the present invention can be configured in a way that the swing motion section and the heat source support section are mounted on the fixing device as FIG. 10 shows. It is preferred that the device mount section 39 representing the swing motion section having the heat source support section 396 to support the heat sources 33 and 34 is mounted on the image forming apparatus A integrally with the fixing device 30. In the above configuration, since the device mount section 39 is included as a component of the unit to be exchanged, dismantling becomes simple and unit exchangeability is enhanced.

FIG. 10 is a front view of the fixing device 30 and the device mount section 39 showing a relevant portion of the fixing device 30 representing an embodiment where the heat sources 33 and 34 can be detached integrally from the image forming apparatus.

The device mount section 39 representing a swing section to support the fixing device 30 is supported by the image forming apparatus A to be capable of being withdrawn to the front side. In a state where the device mount section 39 is withdrawn outside the apparatus A, by loosing a screw fastening the heat source support section 396 onto the mount member 391 of the device mount section 39, the fixing device 30 can be detached from the device mount section 39.

In a state where the fixing device 30 is detached form the device mount section 39 of the image forming device A, the heat sources 33 and 34 are supported by an auxiliary support member 384 fixed onto the housing 381 of the fixing device 30. The auxiliary support member 384 allows the heat sources 33 and 34 to move in a width direction relatively with respect to the fixing device 30 in a state that the fixing device 30 is mounted on the device mount section 39 and the heat sources 33 and 34 are supported by the heat source support section 396. As the figure shows, openings 384A and 384B are provided on the auxiliary support member 384 so as to be isolated from the heat sources 33 and 34.

Also, there is preferred a configuration that the device mount section 39 having the heat source support section 396 is fixed onto the image forming apparatus A and the fixing device 30 is mounted on the device mount section 39 fixed onto the image forming apparatus A. In the above configuration, it is superior costwise since the number of parts of the unit to be replaced is reduced, however a mechanism making the heat source removable from the image forming apparatus A integrally with the fixing device 30 is necessary.

In the above embodiment related to the present invention, the housing 381 of the fixing device 30 representing the fixing member support section 38 to support the fixing roller and the pressure roller can swing without the present invention being limited thereto. There is a preferred configuration that the fixing member support section 38 can swing in the width direction with respect to the housing 381 by separating the fixing member support section 38 from the housing 381 of the fixing device which is within a scope of the present invention.

Incidentally, in the above embodiment related to the present invention the fixing roller 31 and the pressure roller 32 are used as the pair of fixing member without being limited thereto. At least one of the pair of the fixing member can be replaced with an endless belt installed to be rotatable.

FIGS. 11*a* and *b* are schematic diagrams showing an exemplary belt type fixing device that a pair of the fixing members is a heat resist endless belt installed in a rotation manner.

FIG. 11*a* shows an embodiment where one of the pair of the fixing members is a pressure belt 611 to contact with the pressure roller 32 with pressure.

The fixing belt section 61 is configured with an elastic roller 612 in pressure contact with a pressure roller 32, a heat roller 613 to heat the fixing belt 611 through heat conduction and a fixing belt 611 installed and supported by the heat roller 613 and the elastic roller 612 with tension. The fixing belt 611 is rotatable in an arrow direction by driving the heat roller 613 or the elastic roller 612.

As the magnified figure shows, the fixing belt 611 is configured with a heat resist endless belt 611A formed by a polyimide resin, a heat resist elastic layer 611B covering the heat resist endless belt 611A and an outer most layer 611C made of PFA formed on the heat resist elastic layer 611B.

The elastic roller 612 is configured with a roller axis 612A representing a core metal, a heat resist elastic layer 612B formed by foam silicone rubber covering the core metal of the roller axis 612A, and a surface layer 612C made of a silicone rubber having a higher hardness compared with the heat resist elastic layer 612B. There is not heat source in side the elastic roller 612. The heat source 33 is provided in side the heat roller 613 to heat the fixing belt.

One of the pair of the fixing members is a pressure roller 32 which is equivalent to the fixing device in FIG. 2, thus description is omitted.

The fixing belt 611 heated by the heat roller 613 presses the sheet S conveyed through the nip section formed by the pressure roller 32 and the elastic roller 612 which contact each other with pressure.

The sheet S conveyed from the image forming section is lead to the nip section and a toner image is fixed on the sheet S by heat and pressure.

FIG. 11*b* shows an embodiment where one of the pair of the fixing members is a pressure belt 621 to contact with the pressure roller 31 with pressure. Since the fixing roller 31 is equivalent to that in the fixing device of FIG. 2, description is omitted.

The pressure belt section 62 is configured with an elastic roller 622 in pressure contact with a fixing roller 31, a heat roller 623 to heat a pressure belt 621 through heat conduction and the pressure belt 621 installed and supported by the heat roller 623 and the elastic roller 622 with tension. The pressure belt 621 is rotatable in an arrow direction by driving the heat roller 623 or the elastic roller 622.

As the magnified figure shows, the pressure belt 621 is configured with a heat resist endless belt 621A formed by a polyimide resin, a heat resist elastic layer 621B covering the heat resist endless belt 621A and an outermost layer 621C made of a low surface energy resin such as PFA formed on the heat resist elastic layer 621B.

A swing section to swing the pair of fixing members 61 and 32 (or 31 and 62) in the width direction integrally is not described, though the fixing device 30 in FIG. 11*a* and FIG. 11*b* related to the present invention is provided with the device mount section 39 representing the swing section shown in FIGS. 2 to 4 and the pair of the fixing members 61 and 32 (or 31 and 62) is able to swing in the width direction.

On the other hand in spite of swing motion of the pair of the fixing members in the width direction, the heat sources 33 and 34 are fixed onto the device mount section 39 or the image forming apparatus A main body so that the relative positional relation with respect to the sheet S does not change.

Meanwhile, the fixing device related to the present embodiment is preferred to be a pair of fixing members configured with a fixing belt 611 and a pressure belt 621.

As above, in the image forming apparatus reflecting one aspect of the present invention, by displacing the pair of the fixing members relatively with respect to the sheet, the relative positional relation of the heat source with respect to the sheet is maintained consistently whereby, the amount of heat supply to each portion of the sheet is properly balanced and the lifespan of the fixing roller can be extended without occurring uneven fixing (gloss and degree of fixing) and crinkle of the sheet.

What is claimed is:

1. An image forming apparatus, comprising:

an image forming section to form a toner image on a sheet;

a fixing device to fix the tone image on the sheet at a nip section having a pair of fixing members pressing each other to form the nip section and a heat source disposed on at least one of the fixing members to heat the fixing members;

a swing section to swing the pair of the fixing members so that the fixing members displace relatively with respect to the sheet in a width direction which is perpendicular to a sheet conveyance direction, and a heat source support section to support the heat source in a way that a position of the heat source is maintained constantly with respect to the sheet in the width direction.

2. The image forming apparatus of claim 1, further comprising a fixing member support section capable of moving in the width direction to support the fixing members in a rotation manner, wherein the swing section swings the fixing member support section in the width direction.

3. The image forming apparatus of claim 2, wherein the fixing device or a housing of the fixing device is the fixing member support section.

4. The image forming apparatus of claim 1, wherein the fixing device is detachable from an image forming apparatus main body and the swing section and the heat source support section are disposed at the image forming apparatus main body.

5. The image forming apparatus of claim 4, further comprising an auxiliary support member fixed onto the fixing device wherein the auxiliary support member allows the heat source to move in the width direction with respect to the fixing device which supports the heat source while the fixing device being detached and swings the heat source in the width direction while the fixing device being attached.

6. The image forming apparatus of claim 1, wherein the fixing device is detachable form an image forming apparatus main body and the swing section and the heat source support section are disposed at the fixing device.

7. The image forming apparatus of claim 1, wherein the fixing member is a roller configured with a substrate in a shape of a roller on which a heat resist resin is formed.

8. The image forming apparatus of claim 1, wherein one of the fixing members configured with a heat resist resin is an endless belt disposed in a rotation manner.

* * * * *